US009931018B2

(12) United States Patent
Cole

(10) Patent No.: US 9,931,018 B2
(45) Date of Patent: Apr. 3, 2018

(54) FABRIC CARE DEVICE

(71) Applicant: Kim Cole, Westmount (CA)

(72) Inventor: Kim Cole, Westmount (CA)

(73) Assignee: GLEENER INC., Montreal (CA)

( * ) Notice: Subject to any disclaimer, the term of this patent is extended or adjusted under 35 U.S.C. 154(b) by 0 days.

(21) Appl. No.: 15/490,137

(22) Filed: Apr. 18, 2017

(65) Prior Publication Data

US 2017/0280967 A1 Oct. 5, 2017

Related U.S. Application Data

(63) Continuation of application No. 14/183,076, filed on Feb. 18, 2014, now Pat. No. 9,622,643, which is a continuation of application No. 13/056,429, filed as application No. PCT/CA2010/001545 on Sep. 28, 2010, now Pat. No. 8,683,640.

(60) Provisional application No. 61/247,194, filed on Sep. 30, 2009.

(51) Int. Cl.

| | |
|---|---|
| ***A47L 25/00*** | (2006.01) |
| ***A47L 25/08*** | (2006.01) |
| ***A46B 7/04*** | (2006.01) |

(52) U.S. Cl.

CPC ..... *A47L 25/08* (2013.01); *A46B 7/04* (2013.01); *A46B 7/042* (2013.01); *A46B 7/044* (2013.01); *A47L 25/00* (2013.01); *A47L 25/005* (2013.01)

(58) Field of Classification Search

CPC ..... A47L 25/08; A47L 25/00; A47L 25/005; A46B 7/04; A46B 7/042; A46B 7/044

See application file for complete search history.

(56) References Cited

U.S. PATENT DOCUMENTS

| | | | |
|---|---|---|---|
| 2,934,810 | A | 5/1960 | Kanbar |
| 3,471,977 | A | 10/1969 | Roth |
| 3,474,977 | A | 10/1969 | Mott, Sr. et al. |
| 4,642,835 | A | 2/1987 | Schmitz |
| 4,686,731 | A | 8/1987 | Suzuki |
| 5,036,561 | A | 8/1991 | Calafut |
| 5,467,590 | A | 11/1995 | Mencarelli et al. |
| 5,575,031 | A | 11/1996 | Chai |
| D389,619 | S | 1/1998 | Mcleod |
| 5,930,862 | A | 8/1999 | Garrett |
| 7,003,844 | B1 | 2/2006 | Mosby-Pinkney |
| 7,770,294 | B2 | 8/2010 | Bruno et al. |
| 7,856,690 | B2 | 12/2010 | Tuman et al. |
| 8,397,338 | B2 | 3/2013 | Dihn |

(Continued)

FOREIGN PATENT DOCUMENTS

| | | |
|---|---|---|
| CA | 2201975 | 10/1998 |
| DE | 24 316 | 10/1883 |

(Continued)

OTHER PUBLICATIONS

Purdy, Kevin. "Use a Disposable Razor to Remove Sweater Pills." Lifehacker. N. p., Dec. 24, 2007. Web. Mar. 27, 2013. <http://lifehacker.com/337160/use-a-disposable-razor-to-remove-sweater-pills>.

*Primary Examiner* — Shay Karls
(74) *Attorney, Agent, or Firm* — Leason Ellis LLP

(57) ABSTRACT

A fabric care device comprising a body having first and second ends for attaching respective first and second fabric care attachments, wherein at least one of the first and second ends is adapted to detachably attach one of the first and second fabric care attachments. An attachment for a fabric care device selected from the group consisting of a depiller, a delinter, a fabric pile restorer, and a brush.

20 Claims, 17 Drawing Sheets

(56) References Cited

U.S. PATENT DOCUMENTS

| | | | |
|---|---|---|---|
| 8,776,301 | B2 | 7/2014 | Lew |
| 2004/0148721 | A1 | 8/2004 | Spaulding |
| 2005/0184099 | A1 | 8/2005 | McKay |

FOREIGN PATENT DOCUMENTS

| | | |
|---|---|---|
| JP | S60 75492 | 5/1985 |
| WO | WO 95/12997 | 5/1995 |

FABRIC CARE DEVICE

CROSS REFERENCE TO RELATED APPLICATIONS

The present application is a continuation of U.S. patent application Ser. No. 14/183,076, filed Feb. 18, 2014, which is a continuation of U.S. patent application Ser. No. 13/056,429, filed Jul. 11, 2011, which is a U.S. National Phase of International Patent Application PCT/CA2010/001545, filed Sep. 28, 2010, which claims priority to U.S. Provisional Patent Application No. 61/247,194, filed Sep. 30, 2009, each of which is incorporated herein by reference in their entirety.

FIELD OF THE INVENTION

The invention relates generally to a fabric care device.

BACKGROUND OF THE INVENTION

After use and wear, unsightly pills, which are small balls of fibres, or the like can form on the surfaces of some fabrics. Other unwanted material on the fabric surfaces may include lint, dust and loose fibres or hair. Many devices exist to remove these unwanted material from fabric surfaces including powered devices which operate in a similar fashion to electric shavers. However, these powered devices tend to be complicated, inefficient, bulky, cumbersome and expensive, and require a power input necessitating either a plug or batteries which adds to their cost and makes them impractical.

Many non-powered (manual) depilling devices exist which typically comprise a strip of abrasive material or a cutting surface mounted to a support such as a comb, as described and illustrated for example in U.S. Pat. No. 2,934,810, U.S. Pat. No. 3,471,977, U.S. Pat. No. 4,686,731, U.S. Pat. No. 5,036,561, U.S. Pat. No. 5,575,031 and U.S. Design 389,619. A user can grasp such devices by the support and pass the abrasive or cutting surface over the piece of fabric to detach the pills from the fabric. Some of the detached pills will be retained on the abrasive or cutting surface thereby removing them from the fabric surface.

Additional features may be provided for removing the loose material from the fabric surface. For example, the device of U.S. Pat. No. 5,575,031 provides notches in which the detached pills are collected, and the device of U.S. Pat. No. 5,036,561 provides a second delinting surface to collect the loose material. Delinting surfaces typically comprise a tacky/sticky material to which the loose material adheres such as adhesive paper, or a fabric with a slant, hook or loop pile mounted to a support for picking up lint and other loose pieces of unwanted material from the fabric surface. However, these devices tend to be awkward to handle and are limited to depilling and delinting operations only.

Therefore, it is desired to overcome or reduce at least some of the above-described problems.

SUMMARY OF THE INVENTION

The present invention reduces the difficulties and disadvantages of the aforesaid devices. From one aspect, there is provided a fabric care device comprising a body or frame having first and second ends for attaching respective first and second fabric care attachments, wherein at least one of the first and second ends is adapted to detachably attach at least one of the first and second fabric care attachments.

Advantageously, the fabric care attachment which is detachably attachable can be attached when needed and detached when not needed. It can be replaced when worn or old. It can also be replaced by a different type of fabric care attachment e.g. having a different use. For example, in one embodiment, the fabric care device is provided with three types of depillers detachably attachable to one of the first or second ends to treat a range of different fabrics such as natural, synthetic and fabric blends. The different depillers have different treatment surfaces such as different grades of roughness.

Preferably, the fabric care device comprises a handle separating the first and second ends. The handle can be a portion of the body and be integral with the body. The handle can have an overmoulded portion. The overmoulded portion may be made of a rubbery material to improve the user's grip on the handle. Preferably, the handle is ergonomically shaped. The first and second ends can be oppositely facing one another so that a user can use the first and second fabric care attachments without significantly changing their grip on the handle. Also, the fabric care device can be used single handedly by a user.

The fabric care device can further comprise at least one fabric care attachment selected from the group consisting of a depiller, a delinter, a fabric pile restorer, and a brush. The fabric pile restorer can be a metal brush such as pet brush or a brush having aluminium or brass bristles such as for grooming velvet and other materials. The brush can be an electrostatic brush. Other fabric care attachments are possible.

In one embodiment, the fabric care device comprises a depiller detachably attachable to the first end and a delinter attached to the second end. In this embodiment, the delinter is integral with the body or is attached to the body. Preferably, the depiller has a silicon carbide surface and the delinter has a simulated velvet surface. In one embodiment, the silicon carbide surface is a type of 'sandpaper' and can have a grit of about 40 to about 1200, or any other suitable grit size, for removing a variety of sizes of pills. In a preferred embodiment, a silicon carbide paper grit of 400 is used. Any other type of abrasive surface can also be used as the depiller. For example, an aluminium oxide grid or paper having a suitable grit size can also be used.

In another embodiment, the fabric care device comprises first and second fabric care attachments which are detachably attachable to the first and second ends, the first and second fabric care attachments being selected from the group consisting of a depiller, a delinter, a fabric pile restorer, and a brush. The depiller can be used to detach pills from the surfaces of fabrics and other materials. The delinter can be used to remove pills and other debris from the fabric and material surfaces. The fabric pile restorer is preferably a brush which is used to brush a fabric to restore its pile. In one embodiment, the pile restorer is a metal brush, i.e. a brush with metallic bristles, which is used to restore the pile of fleecy and other types of materials.

The fabric care device may further comprise different types of depillers, delinters, fabric pile restorers or brushes, wherein each of the types of depillers, delinters, fabric pile restorers or brushes are interchangeable. For example, a user may detachably attach one type of depiller for removing the pills of one fabric type to the fabric care device and replace this with another type of depiller for another fabric type when needed. In this way, a user may treat or maintain a wide range of fabrics and materials with the fabric care device and attachments. The use of the fabric care device can therefore be extended to many uses including pet care and upholstery care. Therefore, the term 'fabric' should be interpreted as including material, fur and any other surface from which debris is required to be removed.

Preferably, the depiller comprises an abrasive or cutting surface selected from the group comprising surfaces including silicon carbide and aluminium oxide, and a blade. The blade can be metallic. The delinter may comprise a delinting surface for retaining loose material, the delinting surface being selected from the group consisting of a fabric with a slant, a simulated velvet, a sticky or tacky surface, an electrostatic brush, and a hook or loop pile material. The fabric care device may further comprise a first attachment mechanism for detachably attaching the fabric care attachment to the first and/or second ends. Preferably, the first attachment mechanism comprises a portion on the first or second end of the fabric care device which is engageable with a corresponding portion on the fabric care attachment. In other words, the ends of the fabric care device and the fabric care attachments are interengageable.

In one embodiment, the first attachment mechanism is a screw lock and the portion on the first or second end of the fabric care device is a radial protrusion or opening. In another embodiment, the first attachment mechanism is a hook lock and the portion on the first or second end of the fabric care device comprises a resiliently biased pair of hooks which are receivable into corresponding indents in the fabric care attachment. The fabric care device further comprises a button for moving the pair of hooks towards and away from one another to release and retain the fabric care attachment. The button can be provided on the handle. The button may protrude from the surface of the handle. The button may be adjacent or proximate a thumb rest provided on the handle.

According to another aspect, there is provided a fabric care device comprising a body having first and second ends, a first fabric care attachment (or accessory) which can be attached and detached ('detachably attachable') to the first end, and a second fabric care attachment fixed ('attached') to the second end. Preferably, the first fabric care attachment is a depiller comprising an abrasive or cutting surface selected from the group consisting of silicon carbide paper, an aluminium oxide grid, and a blade. Preferably, the second fabric care attachment is a delinter comprising a delinting surface for retaining loose material, the delinting surface being selected from the group consisting of a fabric o with a slant, a simulated velvet, a sticky or tacky surface, an electrostatic brush, and a hook or loop pile material.

The fabric care device may further comprise different depiller types which are interchangeable with one another.

Advantageously, the fabric care device further comprises a handle separating the first and second ends. The handle may be a portion of the body and may be integral with the body. The handle may have an overmoulded portion, for example for improving the user's grip on the handle. Preferably, the handle is ergonomic. Preferably, the first and second ends are oppositely facing one another.

The fabric care device can further comprise a first attachment mechanism for detachably attaching the first fabric care attachment to the first end. The first attachment mechanism can comprise a portion on the first or second end of the fabric care device which is engageable with a corresponding portion on the fabric care attachment. The first attachment mechanism can be a hook lock and the portion on the first or second end of the fabric care device can comprise a resiliently biased pair of hooks which are receivable into corresponding indents in the first fabric care attachment. A button or other means may be provided on the fabric care device for moving the pair of hooks towards and away from one another to release and retain the first fabric care attachment.

From yet another aspect, there is provided a fabric care device comprising a depilling surface which is silicon carbide paper. In one embodiment, the silicon carbide surface is a type of 'sandpaper' and can have a grit of about 40 to about 1200 for removing a variety of sizes of pills. In a preferred embodiment, a silicon carbide paper grit of 400 is used. In another embodiment, aluminium oxide paper is used having a grit of about 40 to about 1200 for removing a variety of sizes of pills.

From a further aspect, there is provided use of silicon carbide as a depilling surface for a fabric care device. In one embodiment, the silicon carbide surface is a type of 'sandpaper' and can have a grit of about 40 to about 1200 for removing a variety of sizes of pills. In a preferred embodiment, a silicon carbide paper grit of 400 is used.

From a yet further aspect, there is provided a depilling attachment for a fabric care device, the depilling attachment comprising silicon carbide paper as a depilling surface. Preferably, the depilling attachment is detachably attachable to the fabric care device. In one embodiment, the silicon carbide surface is a type of 'sandpaper' and can have a grit of about 40 to about 1200 for removing a variety of sizes of pills. In a preferred embodiment, a silicon carbide paper grit of 400 is used.

From another aspect, there is provided a delinting attachment for a fabric care device, the delinting attachment comprising a delinting surface selected from the group comprising a fabric with a slant, a simulated velvet, a sticky or tacky surface, an electrostatic brush, and a hook or loop pile material. Preferably, the delinting attachment is detachably attachable to the fabric care device. The simulated velvet can be a looped-weave polyester.

From a further aspect, there is provided a fabric care attachment for a fabric care device, the fabric care attachment comprising a metal brush for restoring pile on fleecy materials.

Preferably, the fabric care attachment is detachably attachable to the fabric care device. From a yet further aspect, there is provided an attachment for a fabric care device selected from the group consisting of a depiller, a delinter, a fabric pile restorer, and a brush. The depiller is an abrasive or cutting surface selected from the group consisting of silicon carbide, aluminium oxide, and a blade. The delinter comprises a delinting surface for retaining loose material, the delinting surface being selected from the group consisting of a fabric with a slant, a simulated velvet, a sticky or tacky surface, an electrostatic brush, and a hook or loop pile material. The fabric pile restorer is a brush, preferably a metal brush.

It will be appreciated that embodiments of the present invention address some of the most common fabric care issues: detaching pills from fabric surfaces and removing the detached pills and other loose material from the fabric surfaces. By pills it is meant any type of unwanted material on a fabric or other material surface which can include knots and other debris on fur or hair.

BRIEF DESCRIPTION OF THE DRAWINGS

Further aspects and advantages of the present invention will become better understood with reference to the description in association with the following drawings in which.

DETAILED DESCRIPTION OF THE INVENTION

Figure 1:
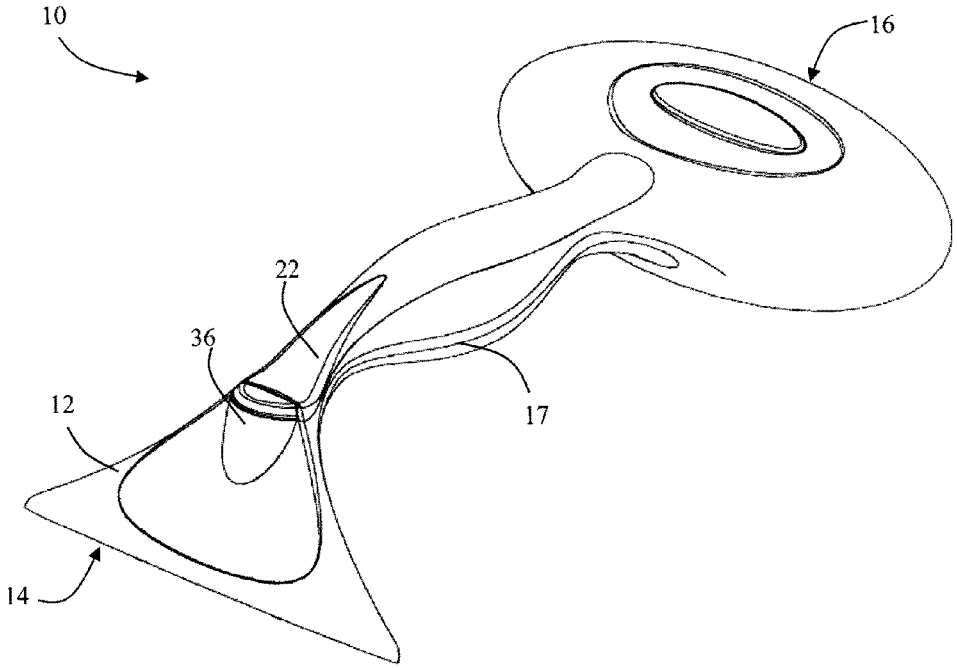
FIG. 1 is a top perspective view from a first end of a fabric care device according to an embodiment of the present invention.
Figure 2:
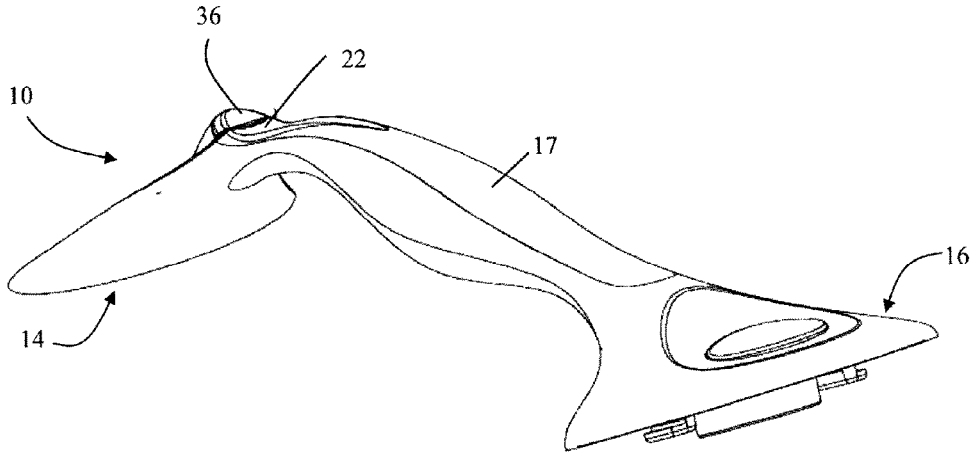
FIG. 2 is a top perspective view from a second end of the fabric care device of FIG. 1.
Figure 3:
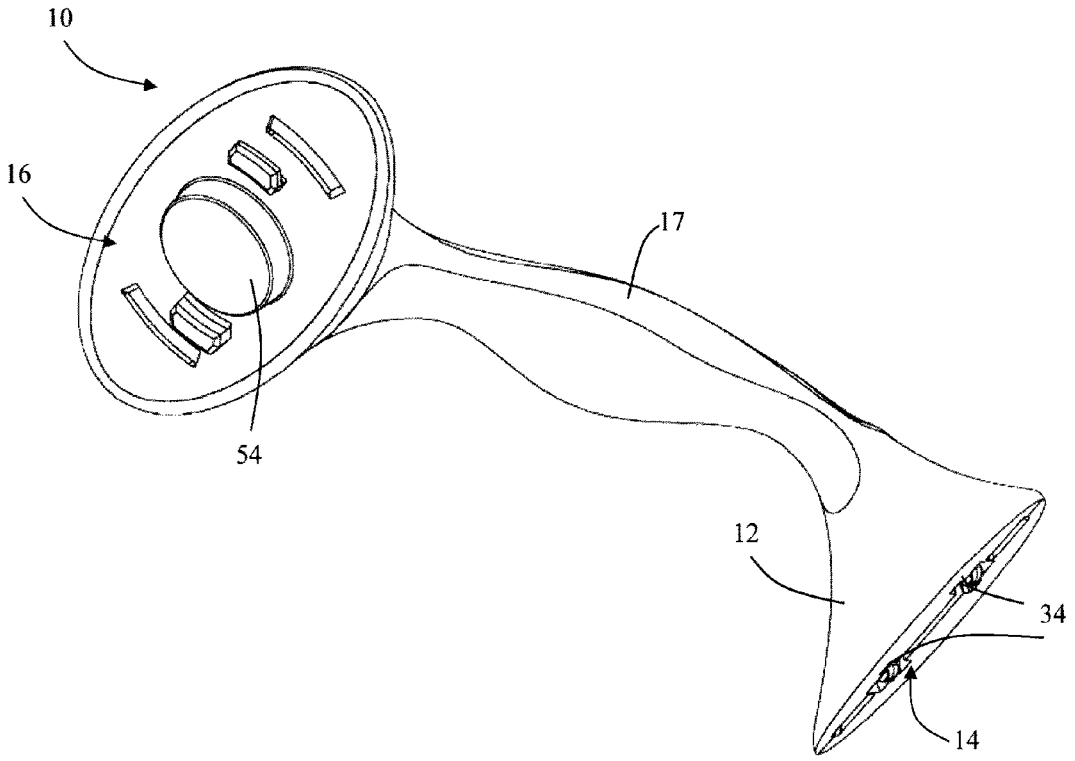
FIG. 3 is a bottom perspective view of the fabric care device of FIG. 1.
Figure 4:
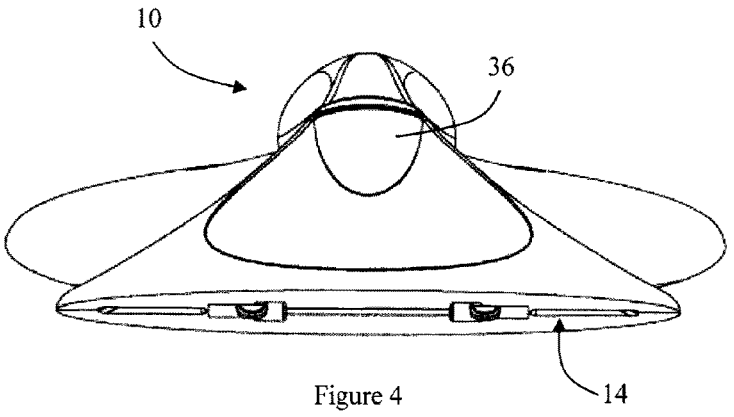
FIG. 4 is a first end view of the fabric care device of FIG. 1.
Figure 5:
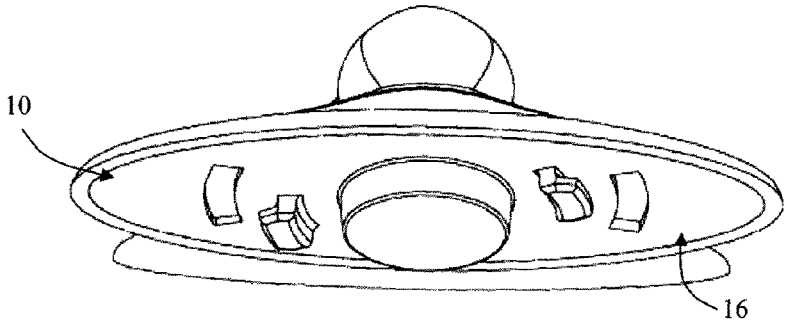
FIG. 5 is a second end view of the fabric care device of FIG. 1.
Figure 6:
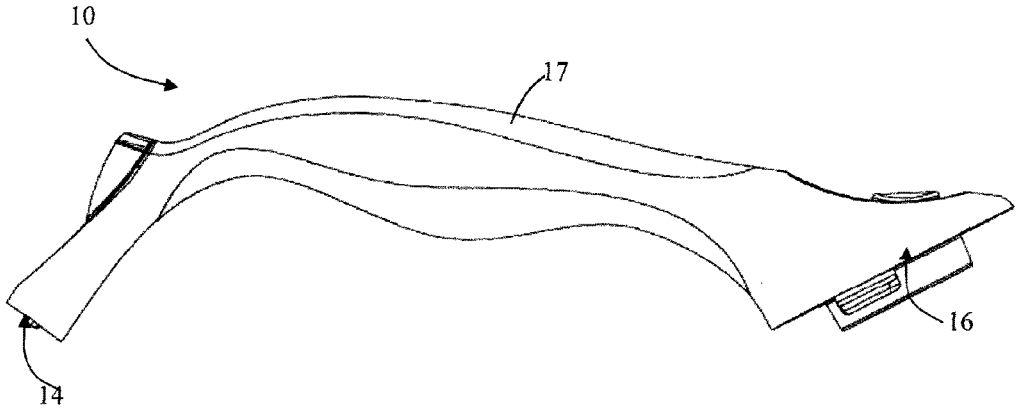
FIG. 6 is a side view of the fabric care device of FIG. 1.
Figure 7:
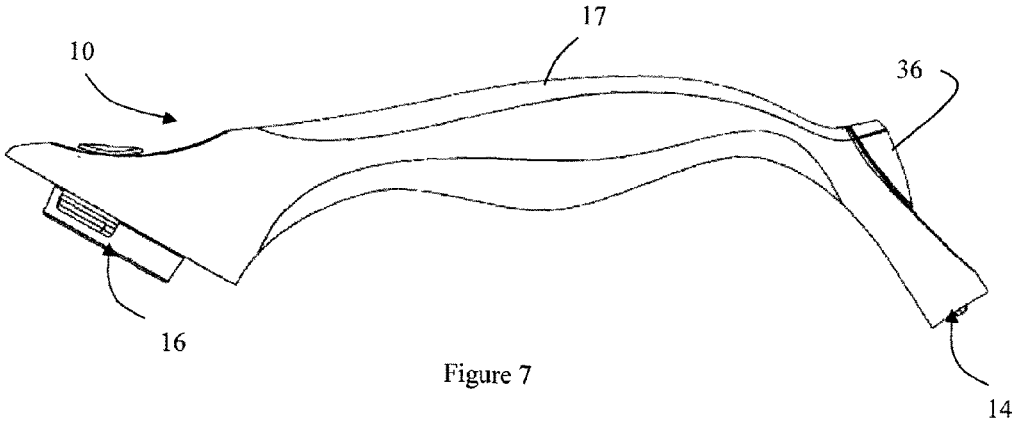
FIG. 7 is another side view of the fabric care device of FIG. 1.
Figure 8:
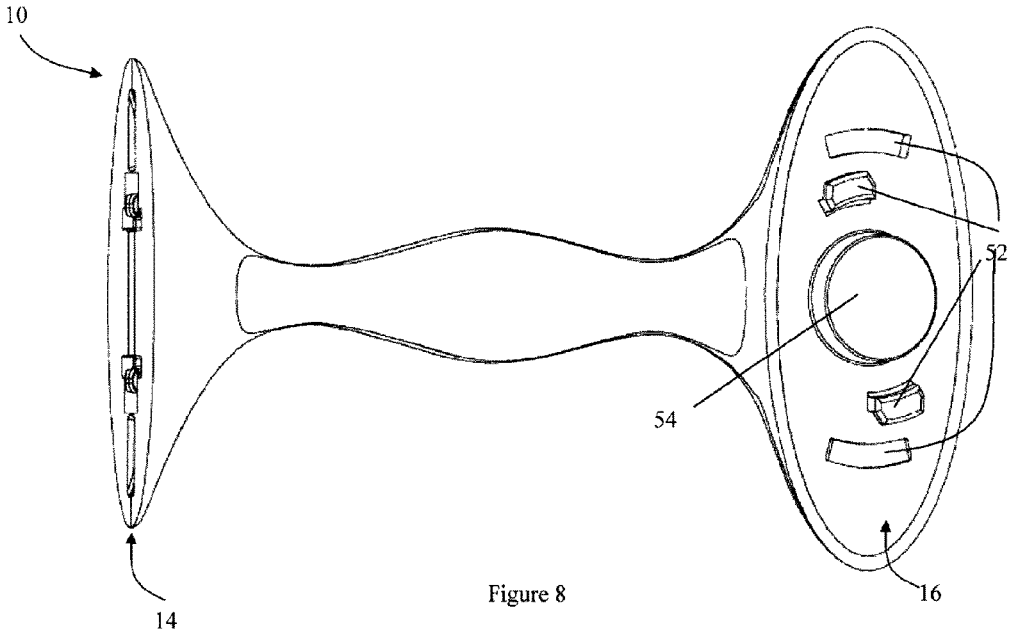
FIG. 8 is a bottom plan view of the fabric care device of FIG. 1.
Figure 9:
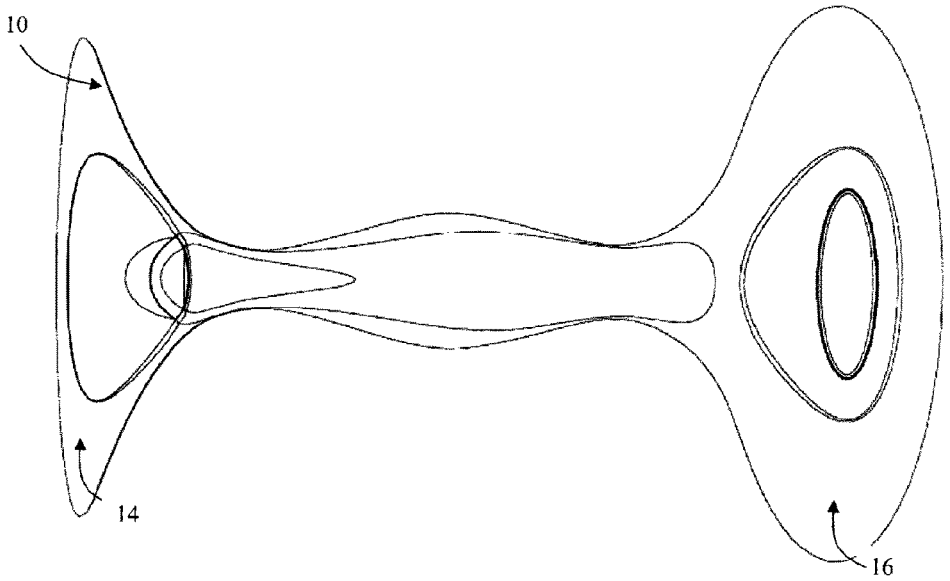
FIG. 9 is a top plan view of the fabric care device of FIG. 1.
Figure 10:
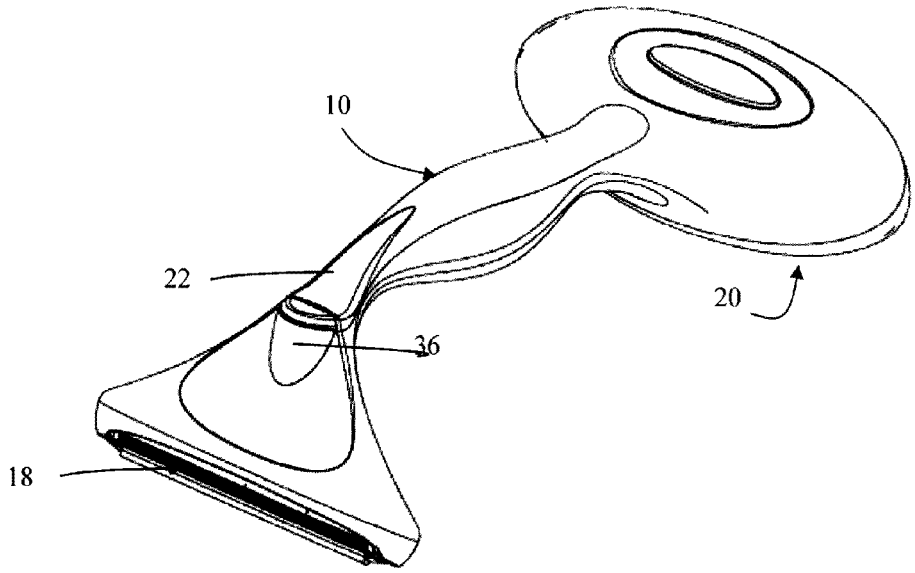
FIG. 10 is a top perspective view of the fabric care device of FIG. 1 with a first and a second fabric care attachment detachably attached to a first and a second end of the fabric care device, respectively, according to another embodiment of the invention.
Figure 11:
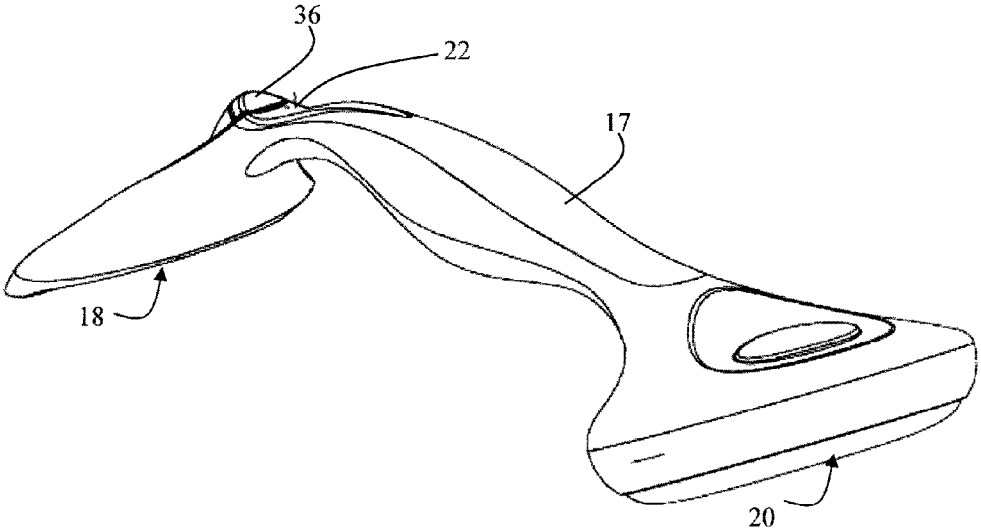
FIG. 11 is a top perspective view from the second end of the fabric care device and attachments of FIG. 10.
Figure 12:
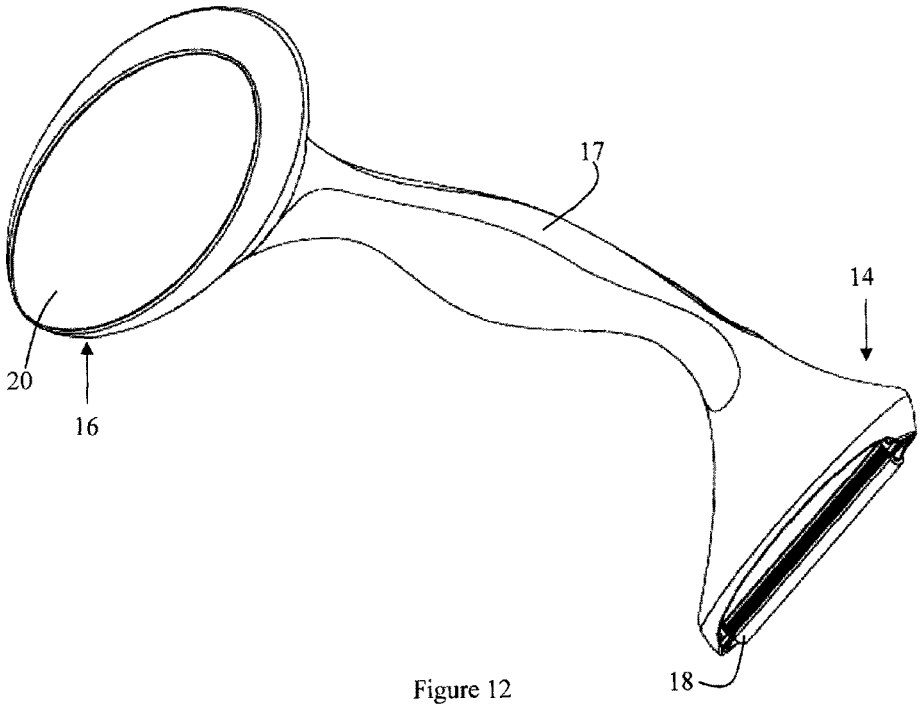
FIG. 12 is a bottom perspective view of the fabric care device and attachments of FIG. 10.
Figure 13:
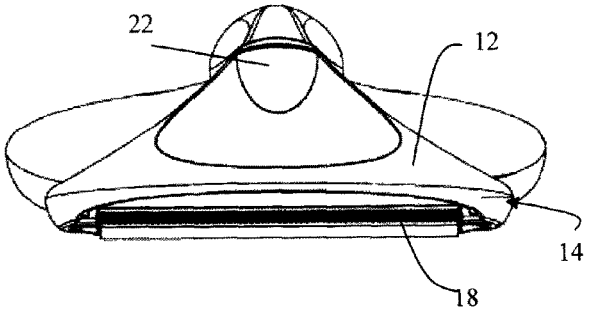
FIG. 13 is a first end view of the fabric care device and attachments of FIG. 10.
Figure 14:
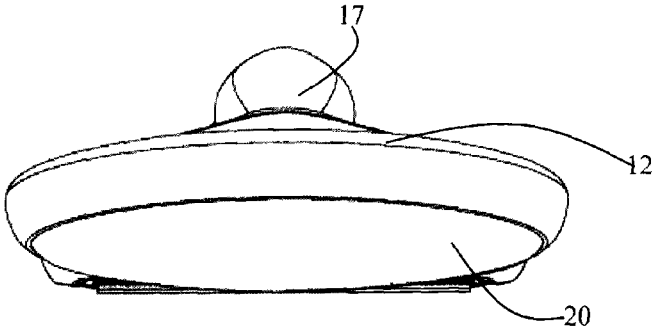
FIG. 14 is a second end view of the fabric care device and attachments of FIG. 10.
Figure 15:
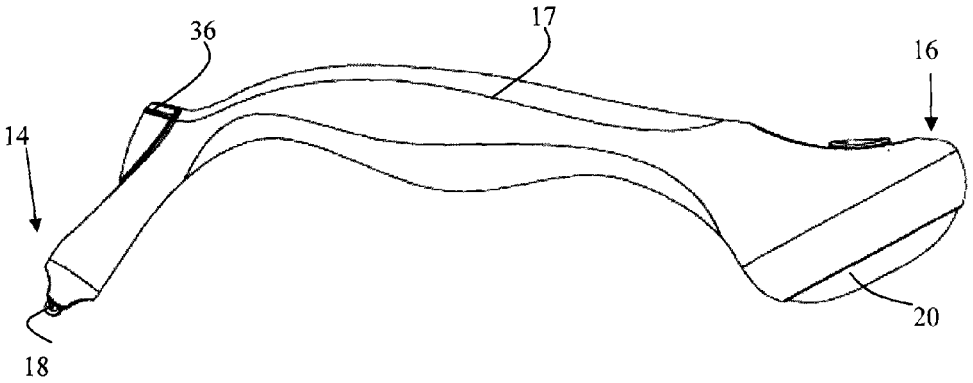
FIG. 15 is a side view of the fabric care device and attachments of FIG. 10.
Figure 16:
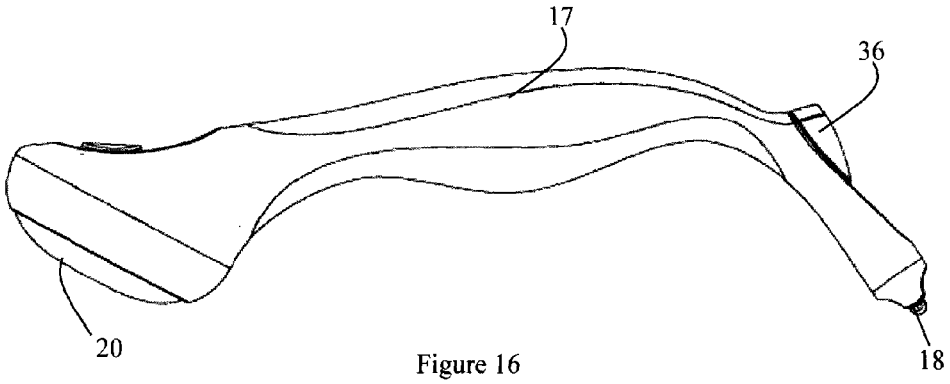
FIG. 16 is another side view of the fabric care device and attachments of FIG. 10.
Figure 17:
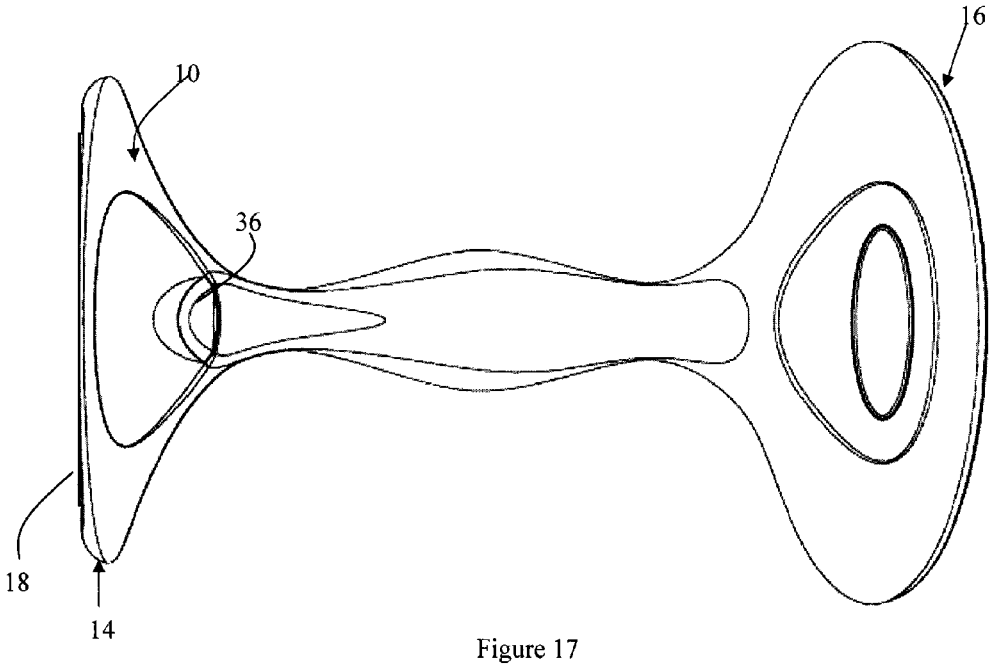
FIG. 17 is a top plan view of the fabric care device and attachments of FIG. 10.
Figure 18:
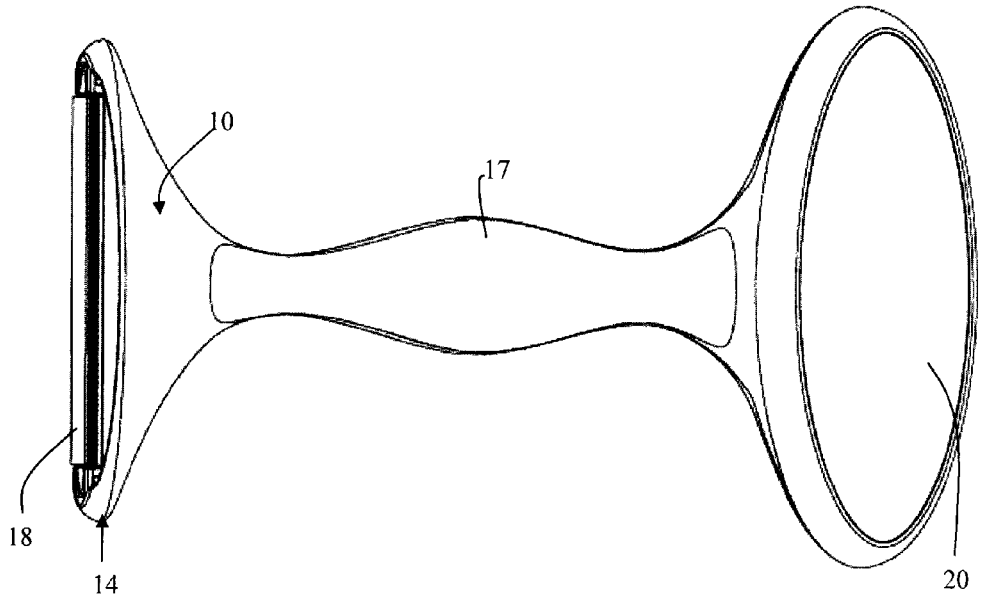
FIG. 18 is a bottom plan view of the fabric care device and attachments of FIG. 10.
Figure 19:
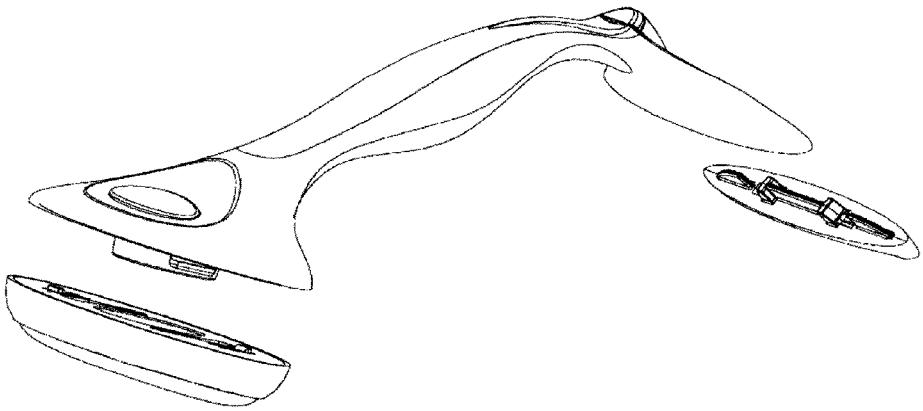
FIG. 19 is an exploded view of the fabric care device and attachments of FIG. 10.
Figure 20:
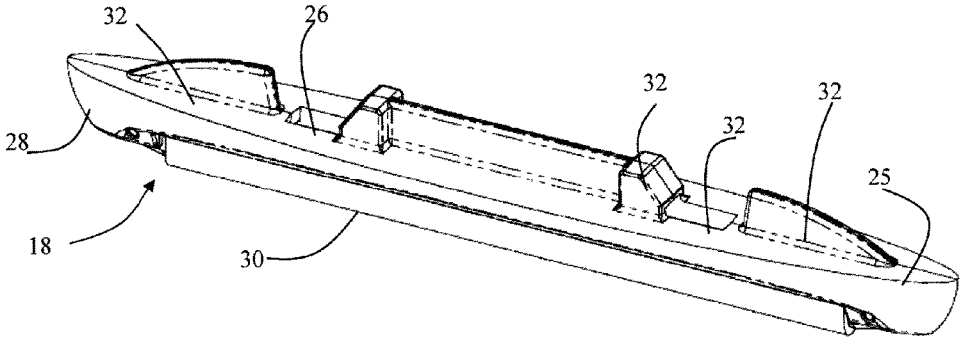
FIG. 20 is a top perspective view of the first fabric care attachment of FIG. 10 according to another aspect of the invention.
Figure 21:
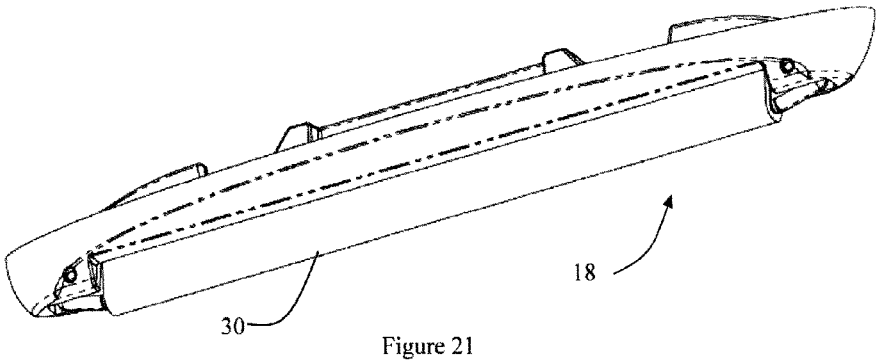
FIG. 21 is bottom perspective view of the first fabric care attachment of FIG. 20.
Figure 22:
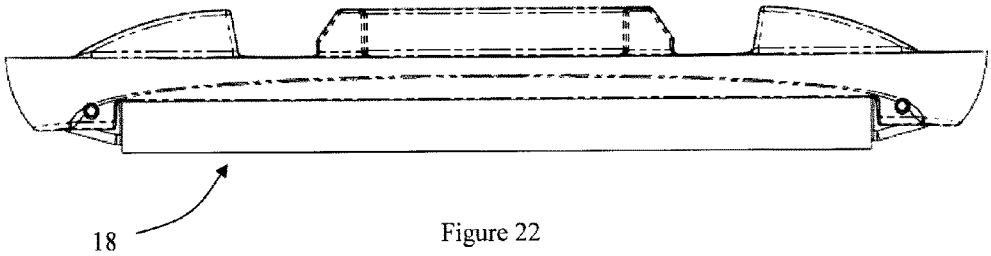
FIG. 22 is a side view of the first fabric care attachment of FIG. 20.
Figure 23:
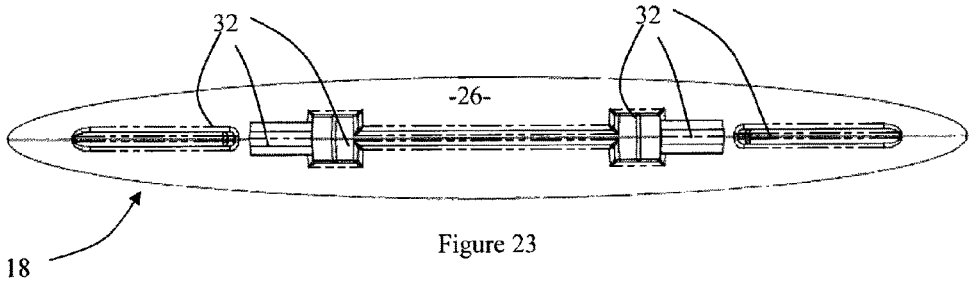
FIG. 23 is a bottom plan view of the first fabric care attachment of FIG. 20.
Figure 24:
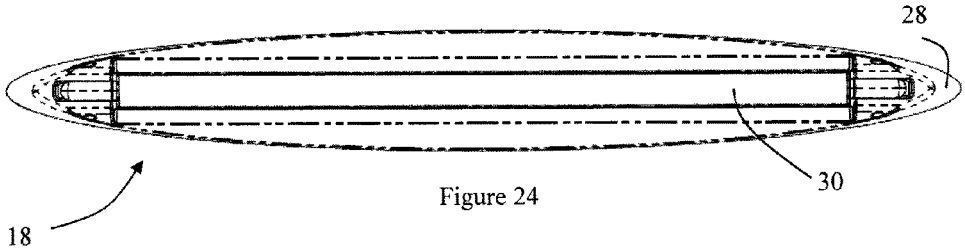
FIG. 24 is a top plan view of the first fabric care attachment of FIG. 20.
Figure 25:
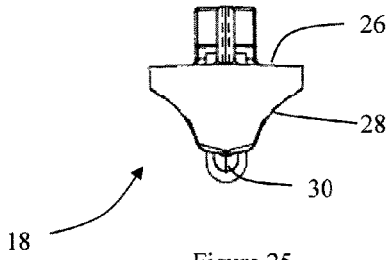
FIG. 25 is an end view of the first fabric care attachment of FIG. 20.
Figure 26:
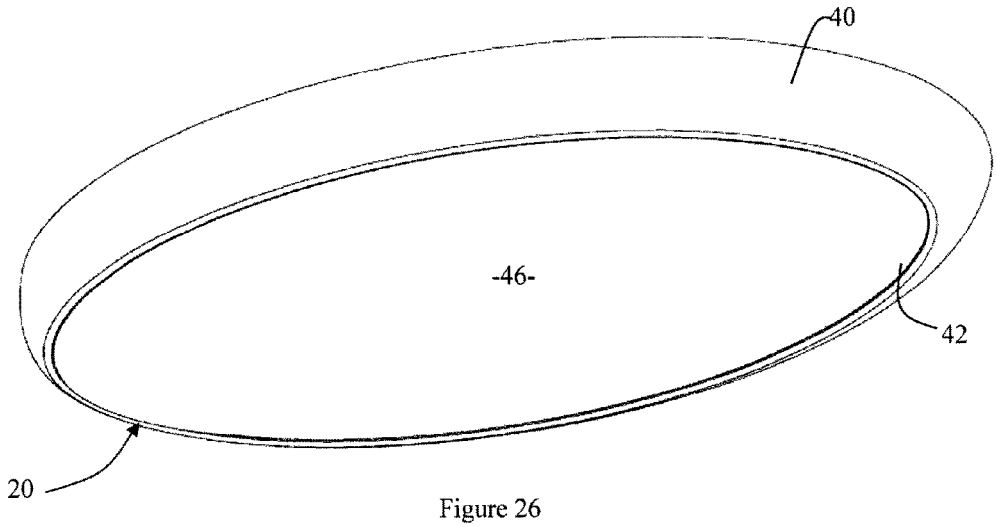
FIG. 26 is a top perspective view of the second fabric care attachment of FIG. 10 according to another embodiment of the invention.
Figure 27:
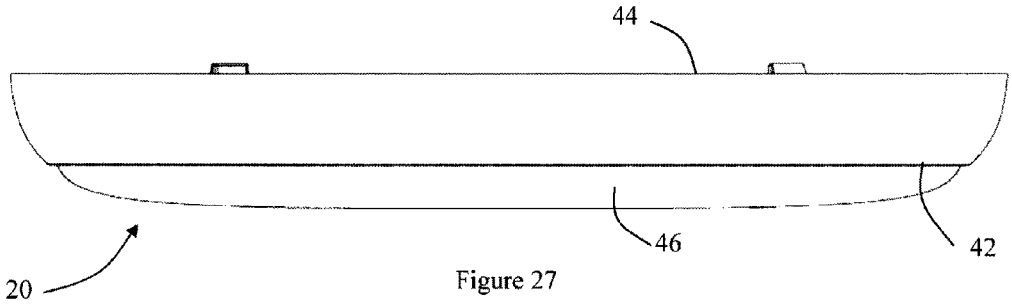
FIG. 27 is a side view of the second fabric care attachment of FIG. 26.
Figure 28:
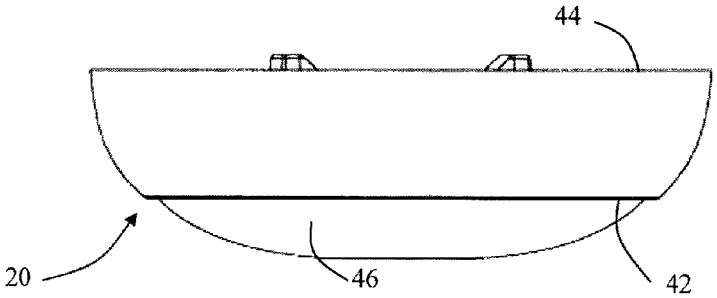
FIG. 28 is an end view of the second fabric care attachment of FIG. 27.
Figure 29:
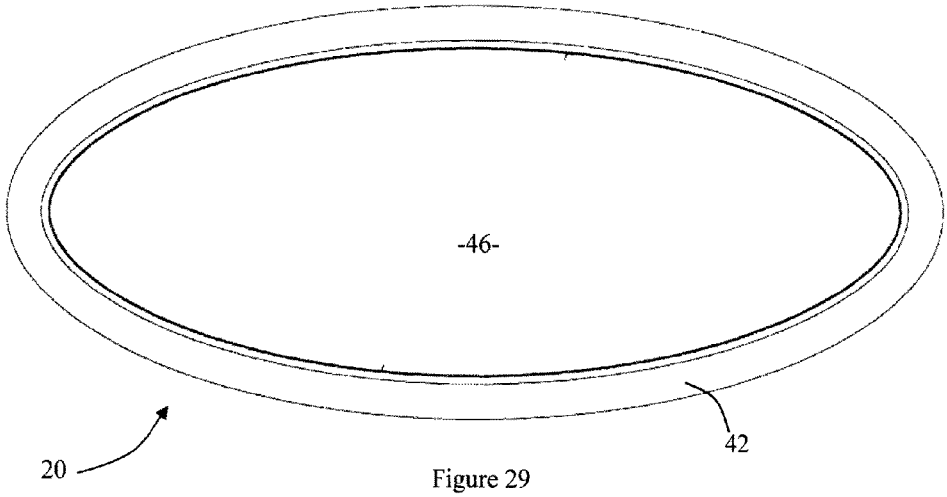
FIG. 29 is a top plan view of the second fabric care attachment of FIG. 27.
Figure 30:
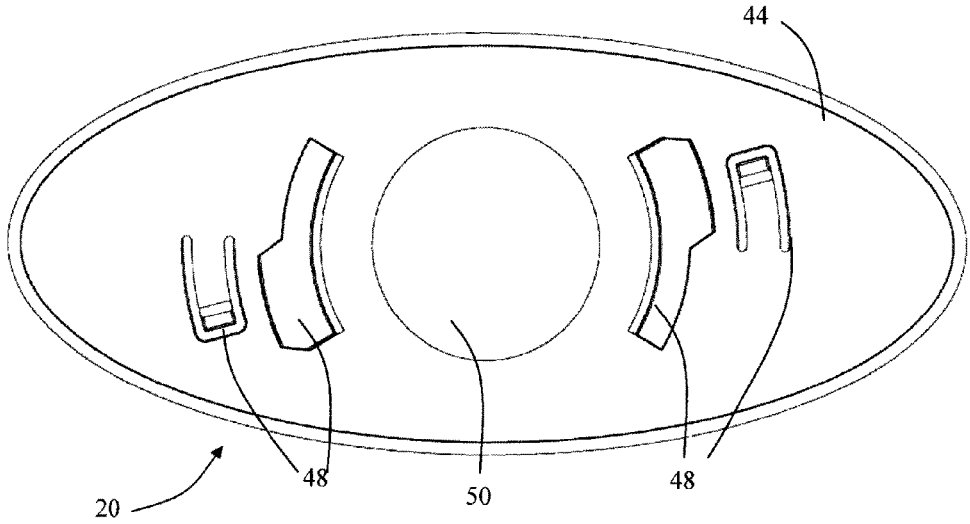
FIG. 30 is a bottom plan view of the second fabric care attachment of FIG. 27.
Figure 31:
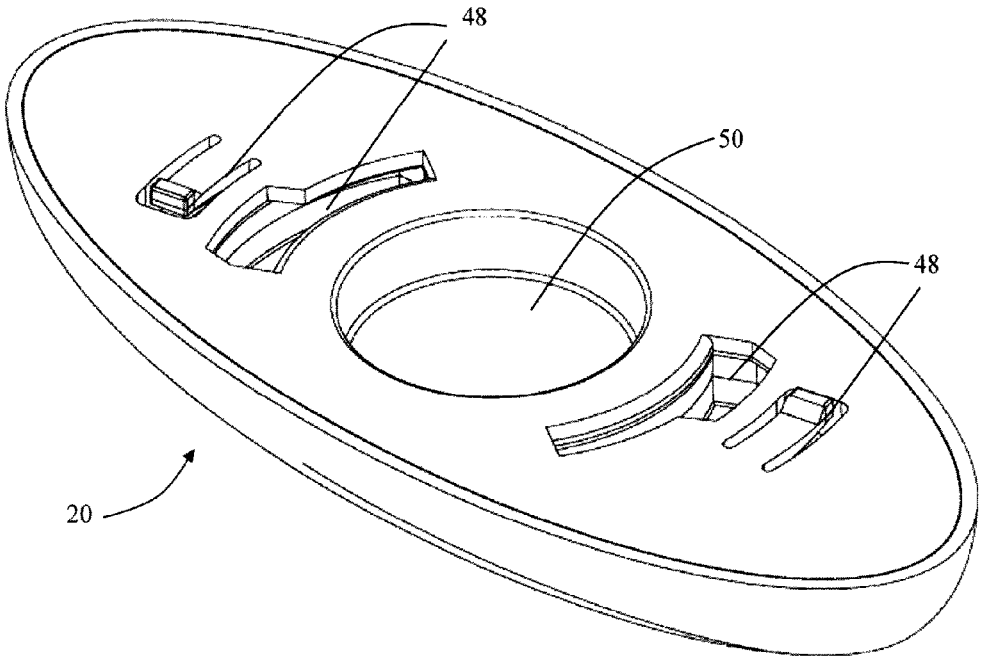
FIG. 31 is a bottom perspective view of the second fabric care attachment of FIG. 27.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including", "comprising", or "having", "containing", "involving" and variations thereof herein, is meant to encompass the items listed thereafter as well as, optionally, additional items. In the following description, the same numerical references refer to similar elements. In the drawings, like reference characters designate like or similar parts.

Figure 32:
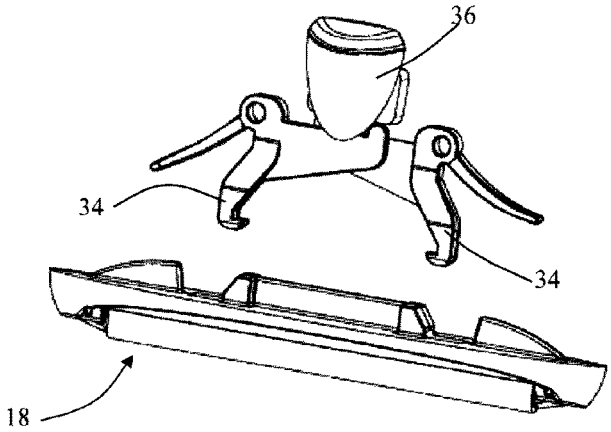
FIG. 32 illustrates an attachment mechanism of the first fabric care attachment of FIG. 10, according to an embodiment of the invention.
Figure 33A:
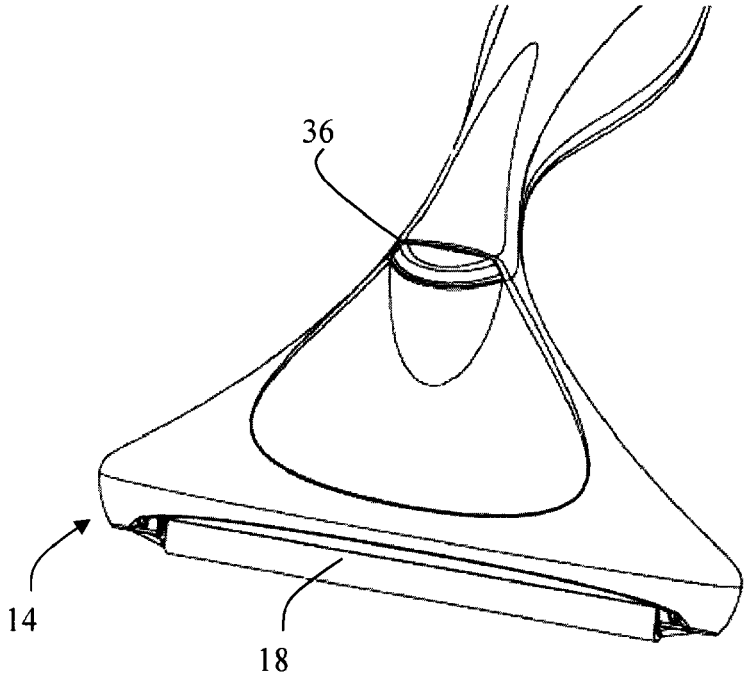
FIGS. 33(*a*) to (*c*) illustrate the detachment of the first fabric care attachment of FIG. 10 from the fabric care device of FIG. 1, according to an embodiment of the invention.
Figure 33B:
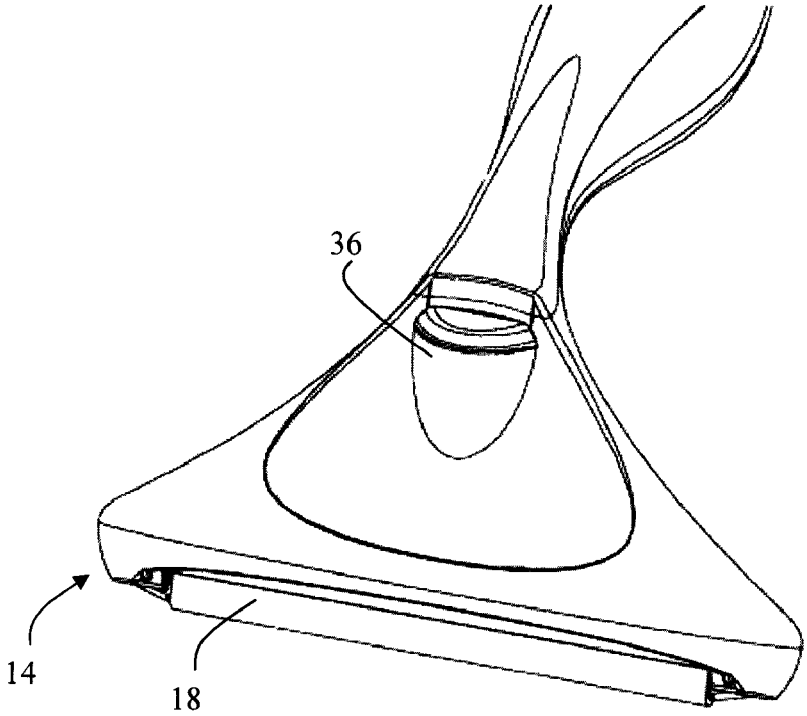
Figure 33C:
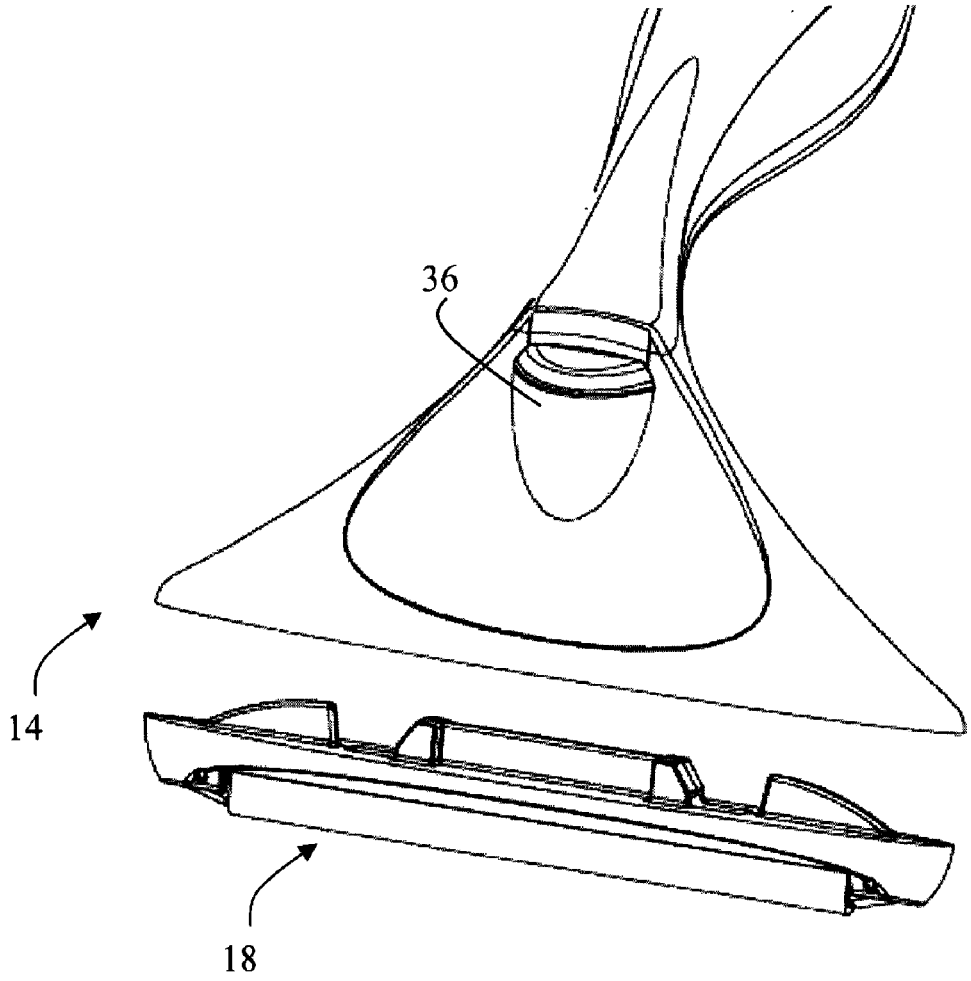
Figure 34A:
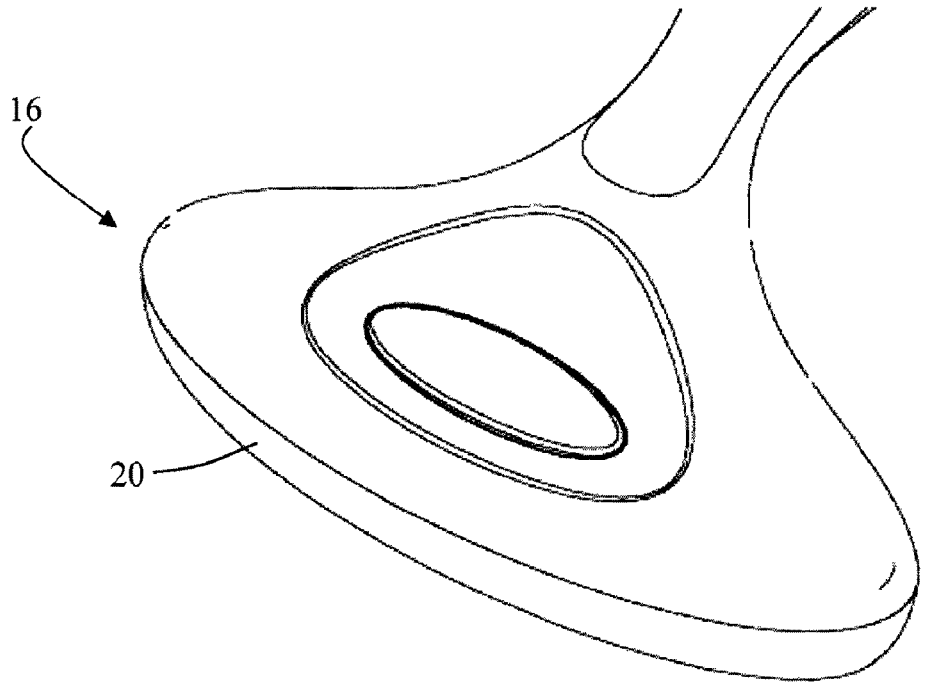
FIGS. 34(*a*) to (*c*) illustrate the detachment of the second fabric care attachment of FIG. 10 from the fabric care device of FIG. 1, according to an embodiment of the invention.
Figure 34B:
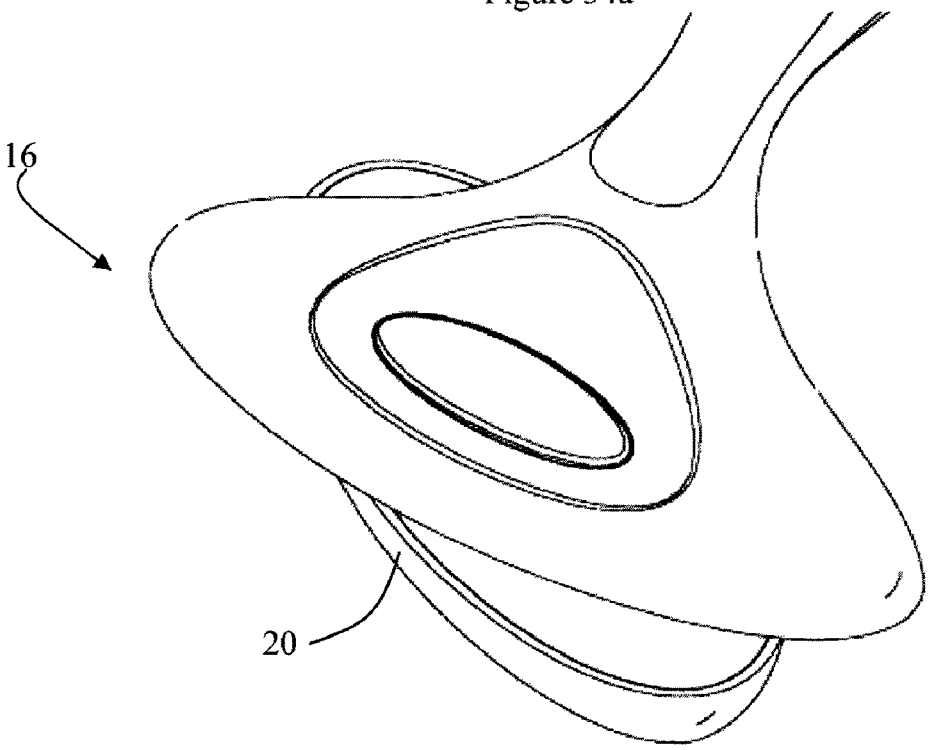
Figure 34C:
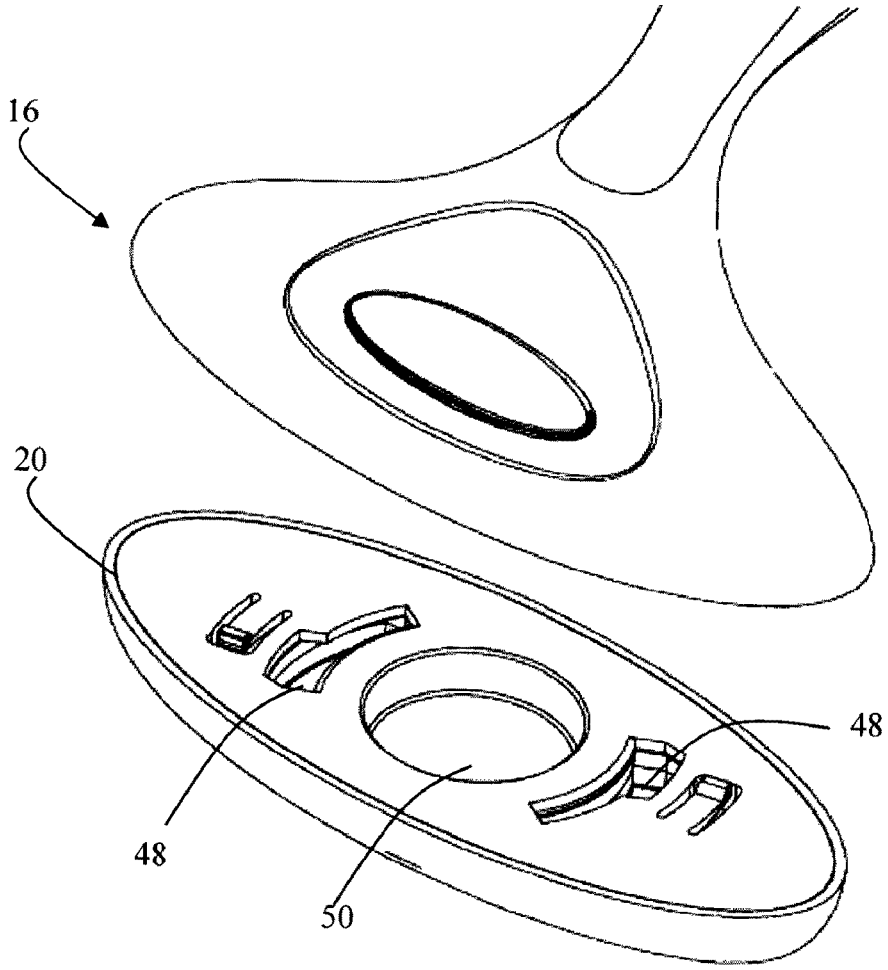

In accordance with one embodiment of the present invention as illustrated in FIGS. 1 to 9, there is provided a fabric care device 10 comprising a body 12 having first and second ends 14, 16 separated by a handle 17. The handle is a portion of the body and can be integral with the body or attached to the body. The first and second ends 14, 16 are arranged to detachably attach first and second fabric care attachments 18, 20 (FIGS. 10 to 19). The fabric care device 10 is a manual, hand held device in that it is intended for manipulation by a user and does not require a power input. The mechanisms of attachment of the first and second attachments to the device are best illustrated in FIGS. 1 to 9 which show the fabric care device 10 without the first and second attachments 18, 20, and FIGS. 32 to 34 illustrating the detachment of the fabric care attachments 18, 20 from the first and second ends 14, 16. In the embodiment of FIGS. 10 to 19, the first fabric care attachment 18 is a depilling tool (a 'depillen'), as illustrated in further detail in FIGS. 20 to 25, and the second fabric care attachment 20 is a delinting tool (a 'delinter') as illustrated in further detail in FIGS. 26 to 31.

The handle 17 is elongate and is ergonomically shaped to facilitate a user's comfortable grip. A thumb rest 22 is provided on an upper surface 24 of the device 10 to further enhance a user's grip and ability to manoeuvre the device 10 across a material surface. In this embodiment, the handle 17 is moulded from two different types of material to enhance grip and comfort further still. For example, Santoprene™, a rubber-plastic mixture material, or polyethylene can be used as the overmould material and polypropylene as the core material. Other materials can also be used, as will be evident to those skilled in the art. An indent for a users forefinger may be provided (not shown) on an undersurface of the device 10.

Referring to FIGS. 20 to 25, the depilling attachment 18 comprises an elongate body 25 having top and bottom faces 26, 28. A depilling surface 30 is provided on the bottom face 28 and a number of protrusions and indents 32 for attaching the depilling attachment 18 to the first end 14 is provided on the top face 26. The depilling surface 30 comprises any suitable surface which can cut or detach pills from a fabric or material, such as a blade having one or a plurality of teeth, or an abrasive surface. The abrasive surface can be made of silicon carbide, aluminium oxide, crushed diamonds or any other suitable material and can be in the form of a sandpaper or the like. The abrasive surface may be arranged in a pattern such as a grid. The abrasive surface can be attached to the body 25 in a manner known to the person skilled in the art such as a paper wrapped around a pin or a plate.

The fabric care device 10 may be provided with a plurality of interchangeable depilling attachments for use with different materials and different types of fabrics or fibres. For example, there may be provided a depilling attachment 18 having a metal blade with teeth for synthetic materials, and one with a silicon carbide or an alumina grid abrasive surface for natural fibres. It will be appreciated that any other type of abrasive or cutting surface can be used as a depilling surface for the depilling attachment 18.

In this embodiment, attachment of the depilling attachment 18 to the device 10 is by means of interengaging portions in the first end 14 and in the depilling attachment top face 26 which mechanically connect the two components together, as best seen in FIG. 32. The first end 14 of the device 10 is provided with a pair of inwardly facing hooks 34 which can be received in corresponding indents 32 in the depilling attachment top face 26. The hooks 34 are resiliently biased towards each other. The hooks 34 can be moved away from each other by pushing or sliding a button 36 on the top surface 24 of the device 10 to release the hooks 34 from their corresponding indents 32 in the depilling attachment 18. Conveniently, the button 36 is adjacent the thumb rest 22 so that a user can release the first attachment 18 from the device using only one hand; the same hand holding the handle without changing his or her grip whilst keeping the other hand free to perform another function. Similarly, the depilling attachment 18 is locked into place by sliding the button 36 towards the first end 14 to separate the hooks 34 from each other, inserting the hooks 34 into their corresponding indents 32 in the depilling attachment 18, and releasing the button 36. It will be appreciated that the hooks may be part of the first attachment instead of part of the device.

Any other suitable mechanism for attaching, locking and detaching the first attachment 18 to the device 10 is also included within the scope of this invention. For example, the first attachment 18 may be detachably attached to the device 10 by a magnetic or mechanical fixation mechanism (e.g. snap fit mechanism or using screws, nails or the like). Alternatively, the first attachment 18 may be integral with the device 10 either by forming the two components together such as by moulding or by attaching the first attachment to the device by adhesive or the like. In a further alternative embodiment, the first attachment may be moveable relative to the device when attached (detachably or otherwise), e.g. by a pivot, hinge or ball and socket joint. Referring now to FIGS. 26 to 31, the delinting attachment 20 comprises an elliptical body 40 having top and bottom faces 42, 44. The body 40 may be a shape other than elliptical, such as rectangular or square. A delinting surface 46 is provided on the top face 42, which comprises a surface for picking up loose material when moved across a material, for example a fabric with a slant such as a simulated velvet, a sticky/tacky surface, an electro-static brush, a hook or loop pile, or any other surface for picking up loose material from a surface. The delinting attachment 20 can also be in the form of a delinting roller, having a washable tacky surface or layer(s) of adhesive, detachably attachable to the device second end 16 and rotatable with respect to the second end 16 for ease of loose material collection. The fabric care device 10 may be provided with a plurality of different types of interchangeable delinting attachments 20 for use with different materials and different types of fabrics and fibres.

In this embodiment, attachment of the delinting attachment 20 to the device 10 is by means of a mechanical fit. The bottom face 44 of the delinting attachment 20 has indents and protrusions for engagement with corresponding indents and protrusions on the device second end 16 for attaching the delinting attachment 20 to the device 10. In this embodiment, the indents on the bottom face 44 of the delinting attachment 20 comprise two slots 48, arranged radially around a central indent 50 in the bottom face 44, each slot 48 having one end wider than the other end. In use, corresponding protrusions 52 on the second end 16 of the device 10 are slotted into the wider ends of the slots 48, and a central protrusion 54 of the device second end 16 is received into the central indent 50 of the delinting attachment 20. The delinting attachment 20 is rotated or turned about the central protrusion 54 of the device so that the protrusions 52 are received in the narrower portions of the slots 48 to lock the delinting attachment 20 in position on the device 10 (a 'screw lock' mechanism). To remove the second attachment 20 from the device 10, the attachment 20 is rotated relative to the device 10 in a counter direction. It will be appreciated that the bottom face 44 of the delinting attachment 20 may have protrusions instead of, or as well as, indents, and that the second end 16 of the device may have indents instead of, or as well as, protrusions.

Any other suitable mechanism for attaching, locking and detaching the second attachment 20 to the device 10 is also included within the scope of this invention. For example, the second attachment 20 may be detachably attached to the device 10 by a magnetic or mechanical fixation mechanism (e.g. snap fit mechanism or using screws, nails or the like). Alternatively, the second attachment 20 may be integral with the device 10 either by forming the two components together such as by moulding or by attaching the components together by adhesive or a mechanical fixation method or the like. In a further alternative embodiment, the second attachment may be moveable relative to the device when attached, e.g. by a pivot, hinge or ball and socket joint. In an alternative embodiment, the fabric care device 10 and the attachments 18, 20 can be made from one or two pieces instead of three separate pieces. For example, the device 10 and the first attachment 18, or the device 10 and the second attachment 20, or the device 10 and both attachments 18, 20, can be a single piece. In one embodiment, the delinting attachment and the device 10 are a single piece.

The fabric care device 10 can be provided with alternative or additional attachments for attachment to the first and/or second ends. One alternative to the delinting attachment is a brush attachment (not shown) having a brushing surface comprising metal teeth (a wire brush), such as those found on pet hair brushes. The metal teeth or bristles may be aluminium or brass or any other type of suitable metal. The inventor has surprisingly found that brushing with this metal brush restores pile on fleece clothing. The brush attachment can also be provided with rubber teeth to remove loose material such as pet hair and fur and other fibres. Advantageously, the rubber brush can be used wet or dry. A lint roller can be provided as an additional or alternative attachment. The lint roller can be washable or may comprise adhesive paper layers. The attachment mechanism of the lint roller to the handle may be arranged to enable the lint roller to pivot with respect to the handle to facilitate delinting an uneven surface, such as clothes which are being worn by the user or upholstery.

In yet another embodiment, the fabric care device 10 can be used as a pet care device. Accordingly, at least one of the attachments may be adapted for this use. For example, the first attachment can comprise a comb or brush suitable for combing or brushing animal fur. A number of comb or brush attachments, which can be detachably attached to the handle, can be provided which are suitable for different types of fur for different pets, e.g. cats and dogs. The second attachment can be a delinting brush or an electrostatic brush.

In use, a user passes the first end 14 with the depilling attachment 18 over a fabric or other surface to detach pills or other debris from the surface. Some of the pills and debris may be retained on the depilling attachment 18. The remaining loose pills and other loose material on the surface can be removed by passing the second end 16 with the delinting attachment 20 over the surface. Advantageously, as the first and second ends are positioned at either end of the handle 17, the user need not change his or her grip on the handle 12 in order to depill and then to delint. In other words, the surface can be depilled and delinted with the same operation. Even if any adjustment to the user's grip is required, there is no need for the user to re-orientate the fabric care device 10 unlike existing fabric care devices which combine depillers and delinters.

Advantageously, by means of at least one of the fabric care attachments 18, 20 being detachable from the handle 12, they can be replaced when required and interchanged as needed depending on the fabric or material being treated and the treatment required. The fabric care attachments 18, 20 can be mounted to the fabric care device 10 such that the attachments can perform their function on a fabric without the user of the device having to re-orient the whole device. i.e. the functional surfaces of the attachments face the same direction when mounted to the device 10. In the case of the depilling and delinting attachments of the first embodiment, the user can separate pills from the surface of a material by passing the delinting attachment end over the material surface. The detached pills can then be removed by passing the delinting attachment end over the material surface to pick up the detached pills and other debris from the material surface. Advantageously, the depilling attachment 18 can be replaced as and when required.

It should be appreciated that the invention is not limited to the particular embodiments described and illustrated but includes all modifications and variations falling within the scope of the invention as defined in the appended claims. For example, the first and second fabric care attachments can be connected to the first and second ends by magnets, a combination of magnets and mechanical fixation, or any other suitable fixation system. The fabric care device can be adapted for other applications, for example as a pet brush (as described above) or an upholstery tool. Therefore, the term fabric should be construed to mean any type of surface from which loose material is desired to be removed.

What is claimed is:

1. A fabric care kit comprising:

a fabric care device comprising a body having a first end and a second end, the first end being adapted to interchangeably detachably attach a first fabric care attachment and a third fabric care attachment to form a first fabric treatment end, the first fabric treatment end comprising a depilling end, the second end being adapted to attach a second fabric care attachment to form a second fabric treatment end;

the first fabric care attachment having a first treatment surface;

the second fabric care attachment; and the third fabric care attachment having a second treatment surface different from the first treatment surface.

2. The kit of claim 1, wherein the body of the fabric care device comprises a handle interconnecting the first end and the second end.

3. The kit of claim 1, wherein the body of the fabric care device comprises a handle interconnecting the first end and the second end, the first end oppositely facing the second end.

4. The kit of claim 1, wherein the first treatment surface is a first abrasive surface and the second treatment surface is a second abrasive surface, the first abrasive surface having a different grade of abrasiveness than the second abrasive surface.

5. The kit of claim 4, wherein the first abrasive surface and the second abrasive surface comprise silicon carbide or aluminium oxide.

6. The kit of claim 1, wherein the first treatment surface is a first cutting surface and the second treatment surface is a second cutting surface, the first cutting surface having a different grade of cutting than the second cutting surface.

7. The kit of claim 1, wherein the depilling end comprises a blade.

8. The kit of claim 1, wherein the second fabric treatment end comprises a delinting end, and the second fabric care attachment has a delinting surface for retaining loose material.

9. The kit of claim 8, wherein the delinting surface is selected from a group consisting of a fabric with a slant, a simulated velvet, a sticky or tacky surface, an electrostatic brush, and a hook or loop pile material.

10. The kit of claim 1, wherein the second fabric treatment end comprises a depilling end, a delinting end, a fabric pile restoring end or a brushing end.

11. A fabric care device comprising:

a body having a first end and a second end;

wherein the first end is adapted to interchangeably detachably attach a first fabric care attachment and a third fabric care attachment to form a first fabric treatment end, the first fabric treatment end comprising a depilling end, and the second end is adapted to attach a second fabric care attachment to form a second fabric treatment end; the first fabric care attachment having a first treatment surface and the third fabric care attachment having a second treatment surface different from the first treatment surface.

12. The fabric care device of claim 11, wherein the body of the fabric care device comprises a handle interconnecting the first end and the second end.

13. The fabric care device of claim 11, wherein the body of the fabric care device comprises a handle interconnecting the first end and the second end, the first end oppositely facing the second end.

14. The fabric care device of claim 11, wherein the first treatment surface is a first abrasive surface and the second treatment surface is a second abrasive surface, the first abrasive surface having a different grade of abrasiveness than the second abrasive surface.

15. The fabric care device of claim 11, wherein the first abrasive surface and the second abrasive surface comprise silicon carbide or aluminium oxide.

16. The fabric care device of claim 11, wherein the first treatment surface is a first cutting surface and the second treatment surface is a second cutting surface, the first cutting surface having a different grade of cutting than the second cutting surface.

17. The fabric care device of claim 11, wherein the depilling end comprises a blade.

18. The fabric care device of claim 11, wherein the second fabric treatment end comprises a delinting end, and the second fabric care attachment has a delinting surface for retaining loose material.

19. The fabric care device of claim 18, wherein the delinting surface is selected from a group consisting of a fabric with a slant, a simulated velvet, a sticky or tacky surface, an electrostatic brush, and a hook or loop pile material.

20. The fabric care device of claim 11, wherein the second fabric treatment end comprises a depilling end, a fabric pile restoring end or a brushing end.

* * * * *